United States Patent [19]

Won

[11] Patent Number: 4,975,988

[45] Date of Patent: Dec. 11, 1990

[54] FOOT-OPERATED TOILET SEAT LIFTING AND LOWERING MECHANISM

[75] Inventor: Jae-Yop Won, 201 Lambton Avenue, Toronto, Ontario, Canada, M6N 2T2

[73] Assignee: Jae-Yop Won, Toronto, Canada

[21] Appl. No.: 186,070

[22] Filed: Apr. 25, 1988

[30] Foreign Application Priority Data

Sep. 17, 1987 [KR] Rep. of Korea ..... 15844

[51] Int. Cl.[5] ..... A47K 13/10

[52] U.S. Cl. ..... 4/251; 4/248; 74/500.5; 74/505; 74/512; 74/421 R

[58] Field of Search ..... 4/238, 250, 251, 253, 4/272, 661, 251, 248, 241, 251, 253; 74/413, 500.5, 505, 512, 660, 481

[56] References Cited

U.S. PATENT DOCUMENTS

| | | | |
|---|---|---|---|
| 686,643 | 11/1901 | Winkler | 74/505 |
| 1,333,747 | 3/1920 | Yoshinaga | 4/251 |
| 1,656,665 | 1/1928 | Dehuff | 74/660 |
| 1,758,111 | 5/1930 | Henderson | 74/660 |
| 1,766,273 | 6/1930 | Wine | 74/505 |
| 2,092,707 | 9/1937 | Zulkoski | 4/251 |
| 2,136,772 | 11/1938 | McCabe | 74/481 |
| 2,525,492 | 10/1950 | Leidy | 4/241 |
| 2,563,095 | 8/1951 | Beyrodt | 4/251 |
| 2,583,872 | 1/1952 | Newcomb | 74/660 |
| 2,661,484 | 12/1953 | Jung | 4/251 |
| 3,303,517 | 2/1967 | Wood et al. | 4/251 |
| 3,476,056 | 11/1969 | Bright | 74/660 |
| 4,281,736 | 8/1981 | Lizzio | 74/512 |
| 4,426,743 | 1/1984 | Seabrooke | 4/251 |
| 4,470,161 | 9/1984 | Seabrooke | 4/251 |
| 4,578,830 | 4/1986 | Chuang | 4/251 |
| 4,766,619 | 8/1988 | Takeda | 4/251 |

FOREIGN PATENT DOCUMENTS

| | | | |
|---|---|---|---|
| 2710391 | 9/1978 | Fed. Rep. of Germany | 74/505 |
| 768873 | 2/1957 | United Kingdom | 4/251 |

*Primary Examiner*—Henry J. Recla
*Assistant Examiner*—Casey Jacyna
*Attorney, Agent, or Firm*—Ivor M. Hughes; Neil H. Hughes

[57] ABSTRACT

It is desirable to be able to lift, lower and lock a toilet seat assembly in position without any hands-on interaction with the toilet seat assembly. In order to accomplish this objective the invention incorporates a selection of devices having additional mechanical advantage when pivoting the seat assembly. In one preferred embodiment of the invention, a cable-operated foot lever is used in combination with a crank portion on the hinge of the toilet seat. In another preferred embodiment of the invention, a system of planetary gears is used in the lever and/or the hinge assembly.

14 Claims, 11 Drawing Sheets

FOOT-OPERATED TOILET SEAT LIFTING AND LOWERING MECHANISM

FIELD OF THE INVENTION

This invention relates to toilet seat lifting mechanisms and has specific application in cable operated mechanisms.

BACKGROUND OF THE INVENTION

In today's environment it is advantageous when using a public washroom to minimize the amount of contact between the user and the facilities. Many washrooms are not kept in order as they should be in terms of level of sanitation and therefore it is desirable to be able to operate a toilet seat without touching said seat. Within the prior art there are a number of mechanisms which disclose devices which lift a toilet seat. However many problems exit within such devices which are yet to be overcome.

U.S. Pat. No. 4,426,743, corresponding to Canadian Pat. No. 1,200,654, assigned to Sani-Seat, Incorporated, discloses a operatorcontrolled, toilet-seat lifting mechanism which has a spring embodied therein creating a constant bias force which when engaged by an operating mechanism as best illustrated in FIG. 3 lifts the toilet seat. However it is necessary for the user of said device to keep constant pressure on the operating means in order to provide the constant upward biasing force to maintain the seat in an upright position. Thus in the preferred embodiment the operator must keep their foot engaging the pedal of FIG. 3. As best illustrated in FIG. 8, a crank rotating in a counter-clockwise direction 82 is provided in the mechanism wherein a bowden cable is conveniently connected at 80. Further, such a device provides no mechanical advantage in the operating means which in the preferred embodiment is a foot-actuated lever to reduce the amount of effort required to raise the toilet seat. The only mechanical advantage really obtained is the crank itself, or the radius at which the cable is set in relation to the center of the pivot for the shaft 26. The foot lever will provide a straight pull which means that the crank 72 will have to move effectively 70° in order to accomplish the task set out by the inventor in the patent disclosure.

U.S. Pat. No. 4,470,161, assigned to Sani-Seat Incorporated, discloses another toilet seat raising mechanism having operator-controlled means for selectively raising and lowering the seat incorporating a control member engaged with the operator-actuated member as a resilient absorbing means. This is best illustrated in relation to FIG. 2. At columns 4, line 7, "The force-absorbing spring 36 prevents damage to the system in the event that the seat 16 is forcibly lowered while the foot pedal remains depressed by an operator's foot.". Thus, again, the operator must maintain their foot in engagement with the pedal while the seat remains raised.

U.S. Pat. No. 4,584,724, discloses a toilet seat lifting and lowering device which may be foot or hand operated and which at column 1, line 34, states that the self supporting base for the foot pedal is positioned in a predetermined spot so that when the toilet seat reaches the upright position, it will remain upright when the user's foot is removed. At column 3, line 9, "The positioning of the base 3 in relation to the toilet 1 is to be adjusted so that when the user's hand is removed, the toilet seat 2 remains upright.". Thus the installation becomes critical in order for the device of U.S. Pat. No. 4,584,724 to work correctly and it is potentially possible that the installer may misinstall or misalign the base thus resulting in a mechanism which only lifts the seat but does not maintain it in its upright position even when the hand or foot is removed. There is no locking engagement.

U.S. Pat. No. 4,649,576 is another example of a footoperated toilet seat device as is U.S. Pat. No. 4,103,371.

U.S. Pat. No. 4,592,097 discloses a seat lifter.

U.S. Pat. No. 4,150,446 discloses an alternative cable system using a lever which is very bulky, contained within a housing and would be a safety and a tripping hazard. Further the toilet tank may interfere with the crank 44 at the top end proximate the pin and toilet seat.

Nowhere within the prior art is there found a toilet seat lifting mechanism wherein the operating mechanism of the toilet seat when operated raises the seat to beyond a predetermined position and locks the seat in that position until the operator disengages or unlocks the locking position allowing the seat to lower wherein as the seat is lowered a dampening device is provided to prevent slamming of the toilet seat.

Further nowhere within the prior art is there found a toilet seat lifting device which provides mechanical advantage beyond that found in a normal crank so as to allow senior citizens and young children who have considerably less muscular strength than an adult to use the device.

It is therefore an objection of this invention to provide a toilet seat lifting mechanism which is easy to use and does not require a great deal of input force to operate.

It is a further object of this invention to provide a toilet seat lifting mechanism which locks in position when actuated by the operator.

It is a further object of this invention to provide a toilet seat lifting mechanism which provides a mechanical advantage in use.

It is a further object of this invention to provide a toilet seat mechanism which amplifies the input displacement sufficiently to raise a toilet seat to a correct amount.

Further and other objects of the invention will become apparent to a man skilled in the art when considering the following summary of the invention and the more detailed description of the preferred embodiments illustrated herein.

SUMMARY OF THE INVENTION

According to one aspect of the invention there is provided a mechanism for lifting and lowering a toilet seat assembly. The mechanism comprises a foot lever which may be depressed to cause a linear displacement in a Bowden cable. The Bowden cable is attached at its end opposite the foot lever to a hinge connecting the toilet seat assembly to the toilet base. The hinge comprises a rotatable shaft (or, pin) which has a first crank connected to it. The Bowden cable is connected to this first crank such that retraction of the Bowden cable will cause rotation of the first crank and rotatable shaft thereby lifting the toilet seat assembly. The toilet seat assembly may be locked once it is in a raised position and may be lowered without touching the toilet seat. Accordingly, locking means are provided to maintain the toilet seat assembly in a raised position and to permit lowering of the toilet seat assembly without touching the seat. All that is necessary is that the locking means comprise means for preventing the rotation of the first crank. In the preferred embodiment of my invention this is achieved by releasably locking the Bowden cable so as to prevent linear displacement thereof. In a preferred embodiment the locking means comprises a releasably movable catch (or, pawl) for engaging the foot lever, whereby any linear displacement of the Bowden cable is secured, and whereby the first crank is prevented from rotating.

According to one preferred embodiment of the invention there is a direct relationship between the arcuate displacement of the lever and the arcuate displacement of the toilet seat in raising or lowering same. Preferably, the foot lever comprises mechanical advantage means having an output to the Bowden cable which is greater than the input to the lever. Preferably, the toilet seat hinge comprises mechanical advantage means having an output for lifting or lowering the seat which is greater than the input from the Bowden cable. According to a further improved embodiment of the invention both the lever and the toilet seat hinge comprise mechanical advantage means, whereby an input to the lever causes a greater output to the hinge for lifting or lowering the toilet seat assembly. Preferably, an input to the lever comprising 15 degrees of arcuate movement will produce an output raising or lowering the toilet seat about 60 degrees of arcuate movement.

According to another preferred embodiment of the invention, the mechanical advantage means for multiplying the output from the lever in response to an input, and/or for multiplying the output from the toilet seat hinge for lifting the toilet seat in response to an input, each comprises a planetary gear system comprising a sun gear, a ring gear interconnected by at least one planetary gear appropriately geared such that an input to the sun gear provides a corresponding output from the ring gear, or an input from the ring gear provides a corresponding output from the sun gear.

According to yet another aspect of the invention, the mechanism may comprise dampening means to control the lowering of the toilet seat assembly when the locking means is released.

According to yet another aspect of the invention there is provided lever means comprising:

(a) input operating means for activating said lever means;

(b) gearing means engaged to said input operating means comprising a planetary gear system having a sun gear surrounded by at least one planetary gear in contact therewith and a ring gear contacting said at least one planetary gear;

(c) output operating means fastened to one of said gears;

(d) housing means containing said gearing means; whereby any input displacement, torque, or force applied to said lever means by said input operating means is modified (for example amplified, magnified or reduced) by said lever means, said displacement, torque or force being transferred to said output operating means by said gearing means, wherein predetermined relationships exit amongst the components of said gear means.

In a preferred embodiment of the invention the gearing means further comprises a sun gear being substantially half of the diameter of the ring gear wherein the input operating means is connected to said sun gear and said output operating means is a cable (such as a bowden cable) attached upon the perimeter of the ring gear.

In another embodiment of the invention the gearing means further comprises a sun gear having substantially half the diameter of the ring gear wherein the input operating means is connected to said ring gear and said output operating means (such as a crank or shaft) is attached to the sun gear.

According to yet another aspect of the invention there is provided for lifting or lowering a toilet seat assembly pivotable upon its rear hinge having a central pivot, at least one lever means comprising:

(a) input operating means for activating said lever means;

(b) gearing means engaged to said input operating means comprising a planetary gear system having a sun gear surrounded by at least one planetary gear in contact therewith and a ring gear contacting said at least one planetary gear;

(c) output operating means fastened to one of said gears;

(d) housing means containing said gearing means; whereby any input displacement, torque, or force applied to said at least one lever means by said input operating means is modified (for example amplified, magnified, or reduced) by said lever means, said modified displacement, torque or force being transferred to said output operating means by said gearing means, wherein predetermined relationships exist amongst the components of said gear means.

In a preferred embodiment of the invention the gearing means further comprises a sun gear being substantially half the diameter of the ring gear wherein the input operating means is connected to said sun gear and said output operating means is a cable (such as a bowden cable) attached upon the perimeter of the ring gear at one end thereof and attached to means to pivot the central pivot of said rear hinge of said toilet seat assembly at the other end thereof.

In yet another embodiment of the invention the gearing means further comprises a sun gear being substantially half the diameter of the ring gear wherein the input operating means is connected to said ring gear (such as a bowden cable) and said output operating means is connected to said sun gear attached to pivot the central pivot of said rear hinge of said toilet seat assembly.

According to yet another aspect of the invention the at least one lever means may comprise a first and second lever means interconnected by cable means, the first lever means comprising a footoperated pedal having one end of the cable means connected to a first ring gear and having the input operating means connected to a first sun gear, the first sun gear being substantially one-half in diameter of the first ring gear; the second lever means comprising a second ring gear connected to the other end of the cable means and having output operating means (for example the pivot of said toilet seat assembly) connected to a second sun gear, the second sun gear being substantially one-half the diameter of the second ring gear and one-quarter the diameter of the first ring gear.

According to yet another aspect of the invention, the mechanism for raising a toilet seat assembly may further comprise releasable locking means to lock the seat assembly in place when raised. In a preferred embodiment thereof the mechanism further comprises dampening means to control the lowering of the toilet seat assembly when the locking means is released.

BRIEF DESCRIPTION OF THE DRAWINGS

The invention will now be illustrated with respect to the following drawings illustrating embodiments of the invention in which:

FIGS. 9B and 9C are alternative embodiments of the invention.

DETAILED DESCRIPTION OF THE PREFERRED EMBODIMENTS

Figure 1:
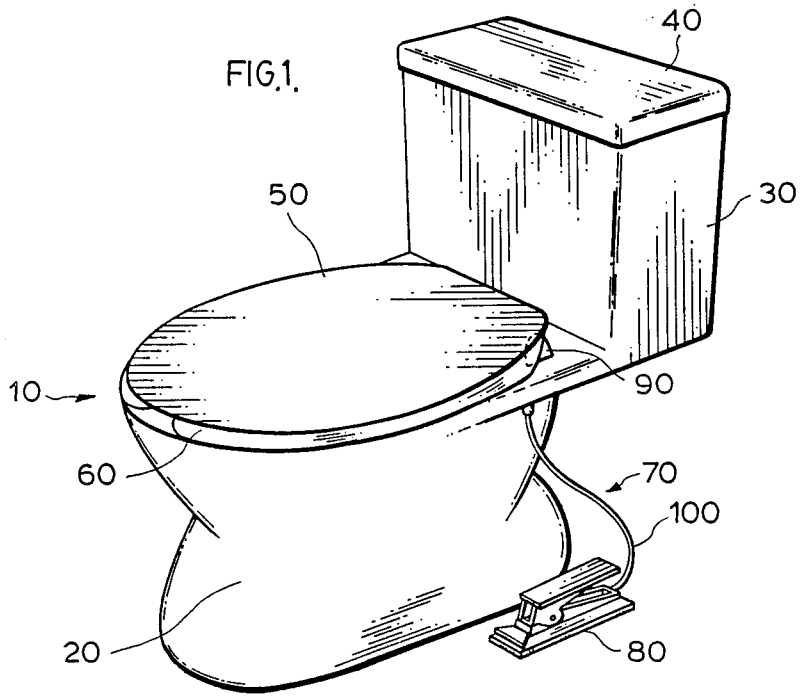
FIG. 1 is a perspective view of the toilet seat lifting apparatus in a preferred embodiment of the invention.
Figure 6:
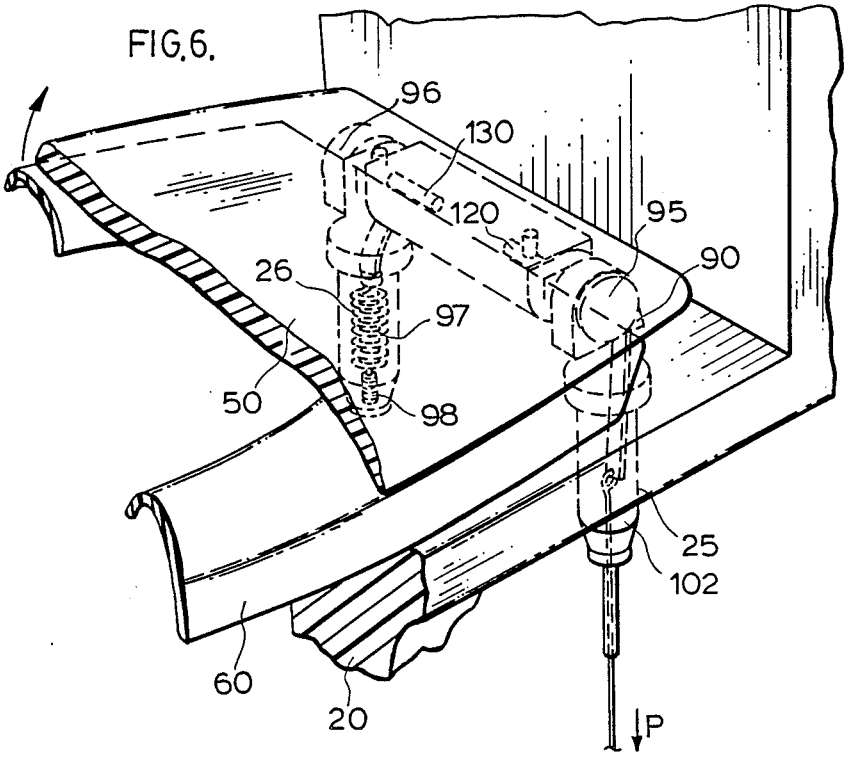
FIG. 6 is a close-up cut-away view in perspective of the view in FIG. 1 indicating in ghost-line the components of the device of the instant invention installed on a typical toilet in a preferred embodiment of the invention.

Referring now to FIG. 1, there is illustrated in perspective a toilet seat lifting mechanism 10 installed on a toilet pedestal 20 typical of those found within the prior art having openings 25 and 26 extending therethrough as best illustrated in relation to FIG. 6. The toilet seat assembly includes a toilet seat 60 and a toilet seat cover 50 typical of those found within the prior art. Installed adjacent the rear hinge of the toilet seat is toilet seat lifting mechanism 70 comprising a hinge member 90 installed adjacent the seat, a cable mechanism 100 connected at one end to the hinge member 90 and at the other end to the foot actuated lever mechanism 80. Behind the toilet seat is as found in convention a toilet tank 3 having a cover 40.

Figure 2:
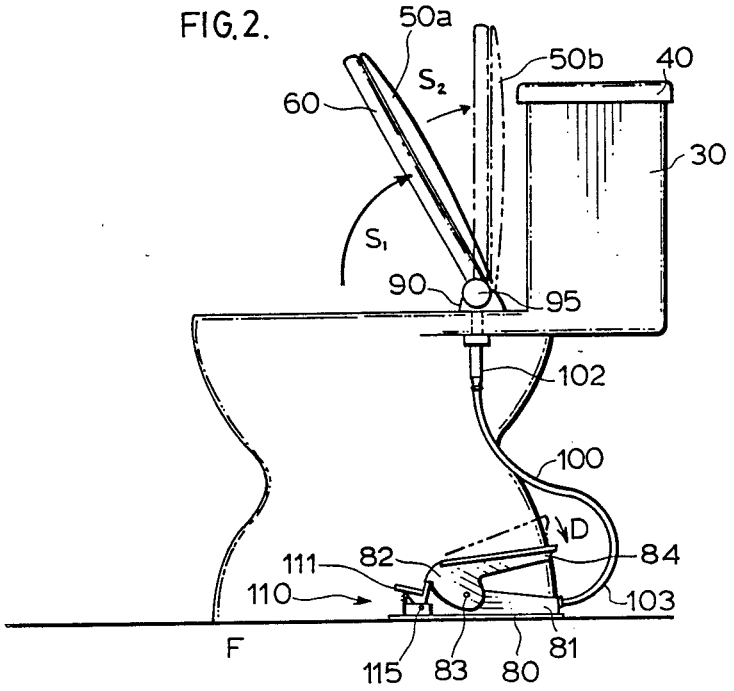
FIG. 2 is a side plan view of the toilet seat incorporating the lifting device of FIG. 1 in a preferred embodiment of the invention.

Referring now to FIG. 2, there is illustrated the pivoting of toilet seat assembly comprising the seat 60 and the lid 50 wherein the lever 80 is pivoted in a direction D which results in the lifting of the toilet seat assembly in a direction $S_1$ to an angle greater than or equal to 60°. The hinge 90 includes a crank 95 attached to the pivoting pins of the toilet seat hinge which will be illustrated and described hereinafter. The cable portions extend through the openings through the porcelain portion of the toilet and include and anchor portion 102 at the end of the cable 100 adjacent the hinge 90. Adjacent the end of the cable 103 is disposed the lever portion actuated by foot operation having a base 81 and a lever portion 82 having an end 84 pivoted about a central pivot 83. There is located at one end of the lever 80 remote the end 84 a pawl or locking mechanism 110 affixed to the lever 80 at one end having a main body portion 115 and a pivotable portion 111. The lever 82 is rotated a distance D in the direction of the arrow shown from its normal position (as outlined in the ghost outline) to a locked position as outlined at end 84 and locked at the end remote portion 84 by the pawl 111. The locking of the lever 82 in the position indicated in FIG. 2 is a very important feature of the invention in that the seat assembly will be locked in position and therefore will not have to be touched by any person using the toilet facilities. If the seat cover 50 is already located in a position $S_2$ as may be the case prior to one using the toilet facilities, then the seat alone 60 will rotate to a position $S_1$. However, if the seat cover 50 is not in the position **50*b*), it will be lifted along with the seat 60 to a position 50*a***).

Figure 3:
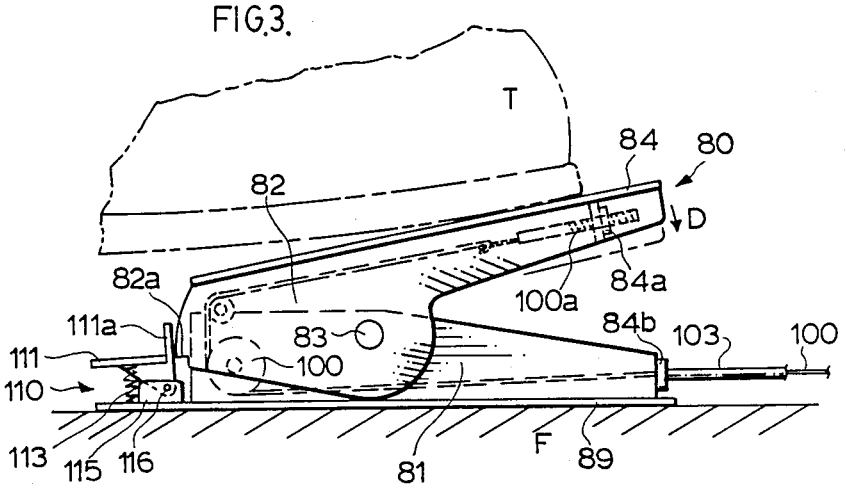
FIG. 3 is a close-up side plan view of a user about to step on the foot-operated device illustrated in FIG. 1 in a preferred embodiment of the invention.
Figure 4:
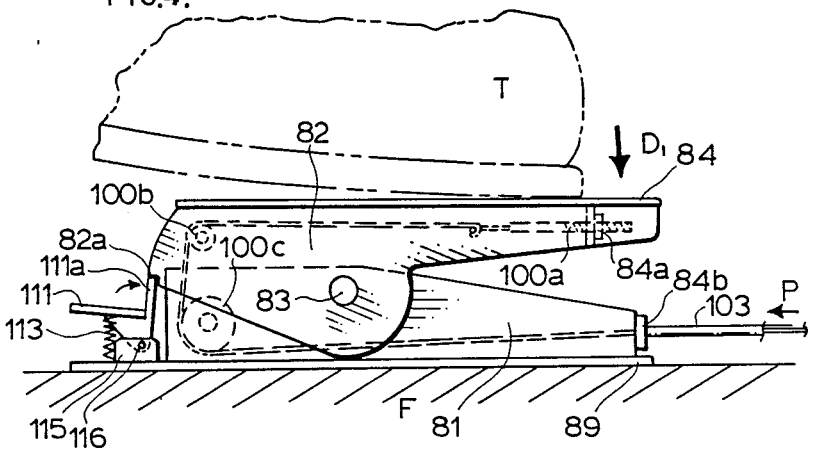
FIG. 4 is a plan side view similar to FIG. 3 wherein the operator has depressed the operating portion a predetermined amount in a preferred embodiment of the invention.
Figure 5:
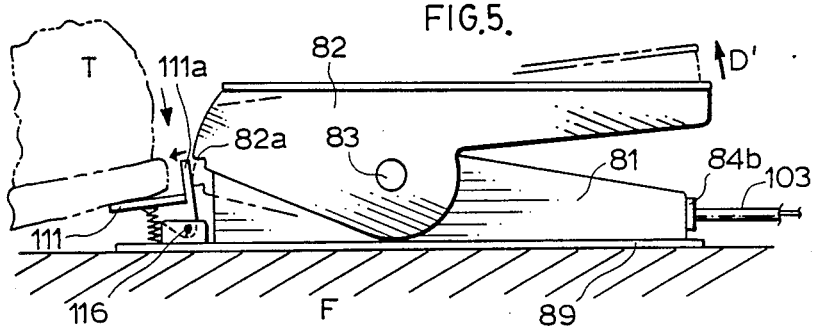
FIG. 5 is a view similar to that of FIGS. 3 and 4 illustrating the user unlocking the operating device in a preferred embodiment of the invention.

Referring now to FIGS. 3, 4 and 5, there is illustrated a close-up partial cross-section of the lever 80 to illustrate and describe the operation thereof. Thus in FIG. 3 there is found a toe portion of the shoe of an operator T initial contacting the lever portion 84 of the foot-operated pedal 80. The cable 100 passes through the end of the foot-operated lever adjacent the fastener **84*b*) at end 103 wherein the cable continues into the base 81 of the lever, the lever portion 82 being pivoted on a pin 83 passing through the base 81. The cable then passes around a pulley 100*c*) and around another pulley to change direction of the pull of the cable wherein it is anchored at the end of the lever portion 82 proximate its end 84 in an anchored portion 84*a*) by conventional methods. Thus the cable is anchored at 100*a*). At the end of the lever 82 remote the end 84 there is located a notch or recess 82*a*) which is pivotably engaged with a pawl 110 having a base portion 115 and a pivotable portion 111 resiliently biased by a spring 113 upon the pivot 116. At the end of the pivotable member 111 there is disposed a detent portion 111*a*). As the foot or toe T is depressed upon the lever 82, a pulling of the cable in a direction P results after the foot is depressed and the lever is depressed a distance $D_1$. The distance $D_1$ is proportional to the amount of rotation required at the upper end of the hinge assembly upon the crank 95 and will be sufficient to rotate said crank 95 a minimum of 60°. As can be readily observed in relation to FIG. 4, when the detent portion 82*a*) passes the side of the detent portion 111*a*), the two portions marry and thus the lever is prevented from rotating toward the foot T until such time as it is released as illustrated in relation to FIG. 5. Thus, when desirable, the user via foot T disconnects the detent 111*a*) from the slot or recess 82*a*) and thereby allows the lever 82 to rotate back to its initial position as illustrated in FIG. 3. It is of course realized that the embodiment of the invention although preferred is not the only embodiment which would accomplish this task. Any detent portions disposed on the lever, whether it be adjacent the end 84 or adjacent the detent portion 82 would work providing that the lever is locked in an advanced position sufficient to prevent the return of the cable to its original position and thus the crank portion 95** to its original position.

Referring now to FIG. 6, there is illustrated in ghost line the components in general terms adjacent the seat assembly when the lever portion passes through the operating modes described in relation to FIGS. 3 to 5. Thus, a cable is pulled a distance P and crank 95 rotates that distance sufficient to rotate the toilet seat assembly to a position substantially greater than or equal to 60°. In doing so, by conventional methods, it may be determined what are length is required for the amount of cable displacement which corresponds to approximately 30 ° of rotation of the lever portion 82 of FIG. 3. Thus the amount of cable moved in a direction P would be equal to the arc distance along the crank 95 and that the crank must turn in order to provide a minimum of 60° of rotation. The arc distance is equal to the product of the radius times the angle of rotation. In solving the equation where P is known and the angle is known, R of course may be determined which would establish the maximum radius for the crank 95. This may be readily observed in relation to FIG. 6. A fastening portion 102 and 102*a*) extend through the openings 25 and 26 respectively. The fastening portion 102 having a connector portion which connects the cable 100 to the crank 95, the details of which are best illustrated in relation to FIG. 7. At the other end of the seat hinge portion is disposed a second crank portion 95 wherein a dampening spring 97 is contained having an adjustment mechanism 98 which is a rotatable device as best illustrated in relation to FIG. 8 which allows adjustment in the amount of resistance the dampening device will provide to a falling toilet seat. For example when in relation to FIG. 5 the pawl 111 is released, the lever is free to rotate to its original position and thus the crank 95 will freely rotate to its original position and thus the toilet seat 60 will be free to rotate to its original position. Conventionally it is known that a toilet seat may slam in doing so. However the invention incorporates a dampening device in one preferred embodiment as illustrated in order to retard and reduce this annoying condition. It is not necessary that the pins 120 and 130 be discontinuous but it is normally the case when installing the toilet seat assembly lifting mechanism on hinges similar to that illustrated. Thus in the embodiment illustrated, when the crank 95 rotates the shaft 120 a minimum of 60° then the toilet seat will rotate in the direction of the arrow indicated and cause the spring 97 to compress within the housing 102*a*) as adjusted by adjusting screw 98 sufficiently to exert a resisting force to a falling seat 60 sufficient to retard its progress and prevent slamming thereof. The housings 102 and 102*a*) conveniently extend through the holes in the porcelain body of the toilet 20 as typically found within toilet bowl structures. No alterations are therefore required and the pivoting assembly may be installed readily upon conventional toilet seats by installing the pins 120 and 130 in the openings normally disposed within the toilet seat assembly.

Figure 7:
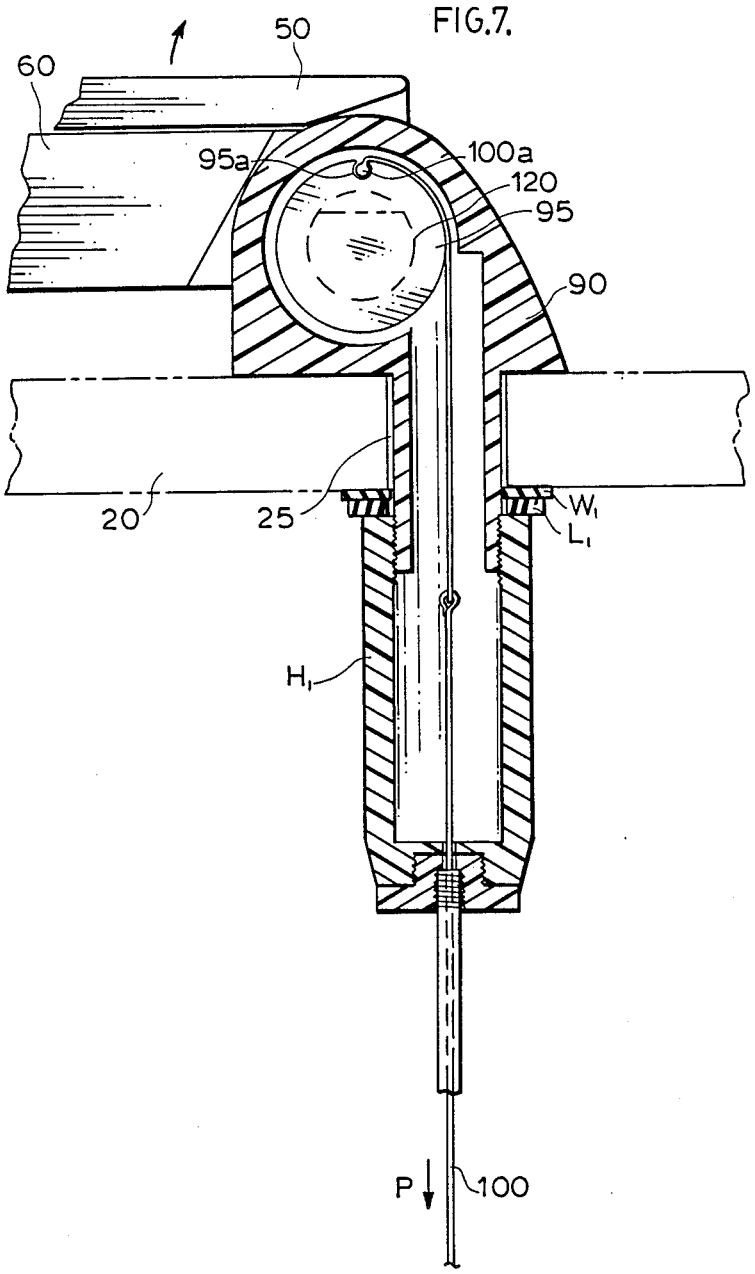
FIG. 7 is a close-up side plan view of the cable-actuated portion or crank in a preferred embodiment of the invention.

Referring now to FIG. 7, there is illustrated a close-up side plan view of the pivot or hinge portion 90 containing the crank 95. Thus hinge portion 90 is a housing covering the crank 95 having affixed in an opening 95*a*) about the circumference thereof a lug or expanded head 100*f*), a continuation of cable 100. The cable may be attached at a detent upon the surface of the crank or as illustrated may be hooked over a supplementary portion of the cable for ease of installation. The housing 90 extends downwardly through the opening in the toilet 20 at 25 wherein a lock washer $L_1$ and a washer $W_1$ lock and retain the housing $H_1$ wherein the cable 100 passes through to the crank portion 95. The crank portion 95 is connected to the pin 120 as illustrated in ghost line where of course the seat and the seat cover 60 and 50 will rotate in the direction indicated when the cable is pulled a distance in the direction P causing the crank to rotate that equivalent distance and thus generating sufficient torque to rotate the shaft or pin 120 and thus the seat assembly. By positioning the cable at 100*f*) a suitable radius from the center of the shaft or pin 120, a sufficient amount of torque and the amplification thereof is obtained. Thus when the foot T is engaging the lever 82, any displacement D will be further passed on to the crank 95 a similar arc length displacement D sufficient to both raise the seat substantially 60° at a minimum, and to magnify the torque upon the pin 120 by placing the location of the detent 100*f*) outside of the radius of the pin or shaft 120 and thus amplifying the amount of torque passed on to the shaft. Of course such a relationship is well known in the prior art in order to obtain mechanical advantage. This results in sufficient force to rotate the toilet seat even though it be at the hinge portion of the assembly.

Figure 8:
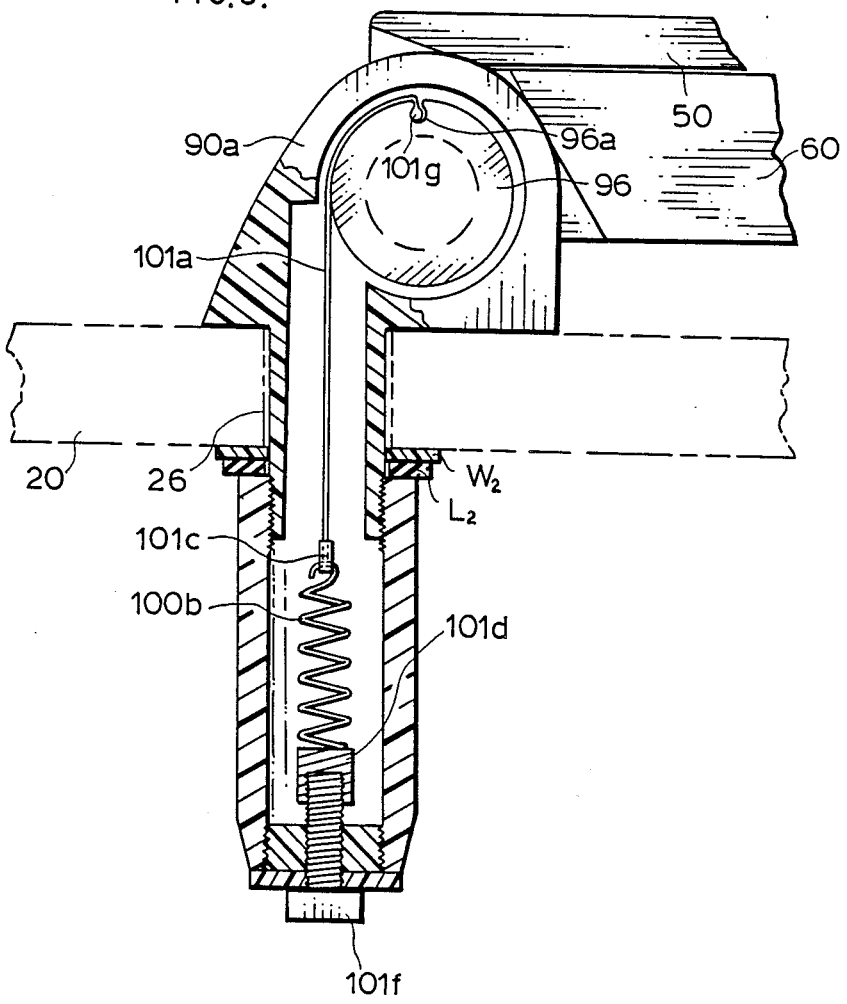
FIG. 8 is a close-up side plan view illustrating the details for the shock absorber in a preferred embodiment of the invention.

Referring now to FIG. 8, there is illustrated in close-up cross-sectional view a second housing 90*a*) having a crank contained therein 96 wherein a shorter cable portion 101*a*) is located therein, the cable being attached at one end by a lug or head 101*g*) within a hole or recess 96*a*) in a crank 96. Such cable 101*a*) passing over the crank and extending down toward the stop mechanism wherein is contained a connector 101*c*) thereto at one end, and a spring 101*b*) of sufficient stiffness to provide the dampening resistance required by the structure, the spring being attached to the other end of the connector 101*c*). Further the spring 101*b*) is connected to an adjustment collar 101*d*) which is movable in relation to a adjusting screw 101*f*). Thus when the adjusting screw 101*f*) is rotated the connecting collar 101*d*) will move toward the pin and thus cause a tensioning in the spring 101*b*). If the opposite result is desirable then the pin 101*f*) may be rotated in the opposite direction. This adjustment is made by the user during installation and tested to ensure that proper dampening of the toilet seat 50 and 60 is obtained when the pawl 111 is released as illustrated in FIG. 5. The crank 96 is a slave portion to the crank 95 and will rotate a corresponding amount to that of crank 95. Thus when the seat assembly 50 and 60 are in an upward position, the spring will be in a non-elastic state and when the seat assembly 50 and 60 is lowered to the position illustrated, the crank 96 will rotate in a clockwise direction and thus offer a specific amount of resistance to the lowering of the seat proportional to the amount of preadjustment applied to the spring 101*b*) by the pin 101*f*).

Figure 9:
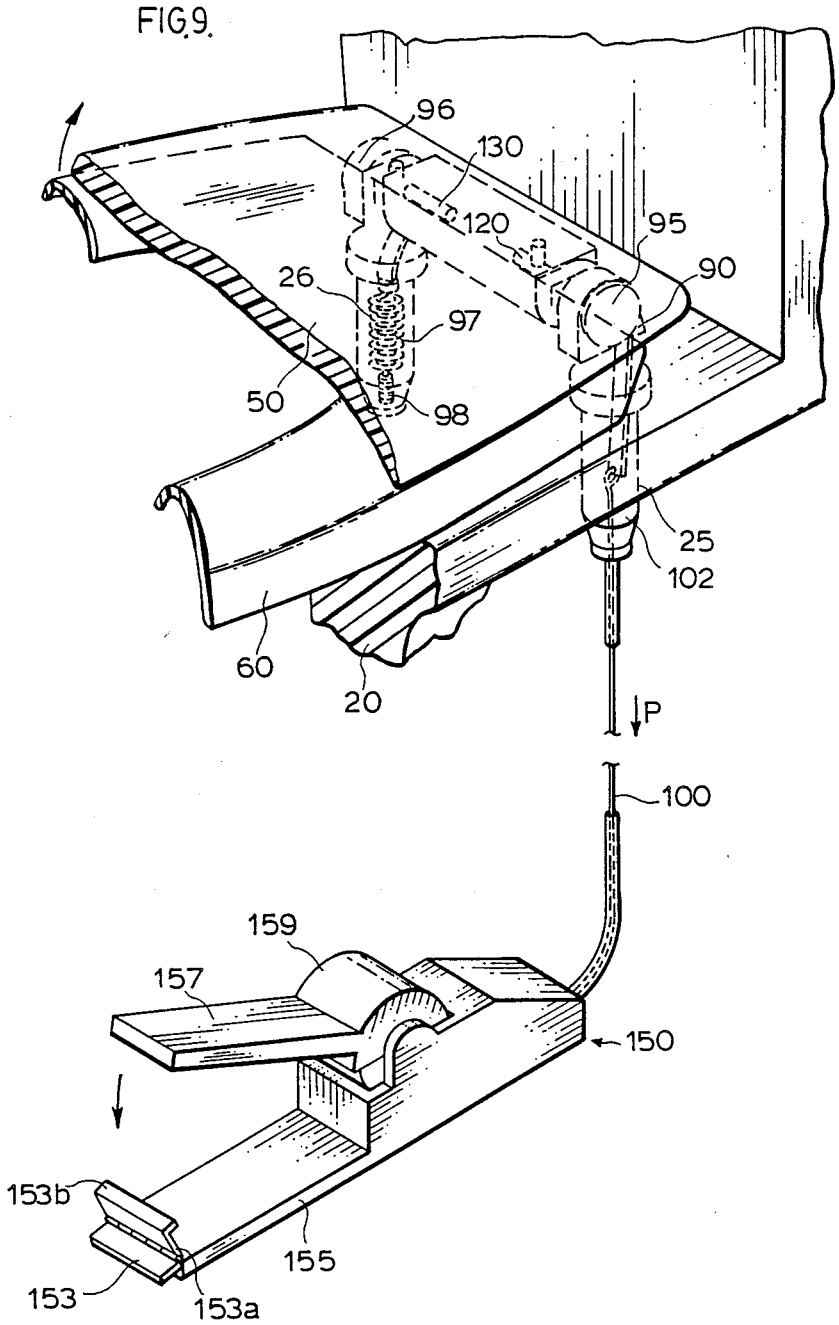
FIG. 9 is a perspective view of the invention similarly illustrated in FIG. 6 and 6A and close-up cut-away view in another preferred embodiment of the invention.

Referring now to FIG. 9, there is illustrated a further preferred embodiment of the invention wherein the upper hinge portions are consistent with those already described but were in the lower portion 150 is a lever portion disposed upon a base 155 having a pivotable lever 157 affixed thereto at a pivot wherein at one end is disposed a releasable locking device 153 having detent portions 153*b*) and 153*a*) wherein the lever portion 157 will lock similar to that described in relation to FIGS. 3 to 5 when the lever 150 is operated. The purpose of the lever is similar to that of FIGS. 3 to 5 but further enhances the mechanical advantage obtained at the lever unlike the lever of FIG. 5 wherein a straight pull is obtained. The lever assembly 150 obtains a mechanical advantage as will be hereinafter described. It is not necessary in every preferred embodiment of the invention to use the crank portion 95 and 96 as illustrated in FIG. 9. Another embodiment of the invention incorporates a planetary gear system disposed in both the hinge portion and the lever portion of the assembly.

Figure 9A:
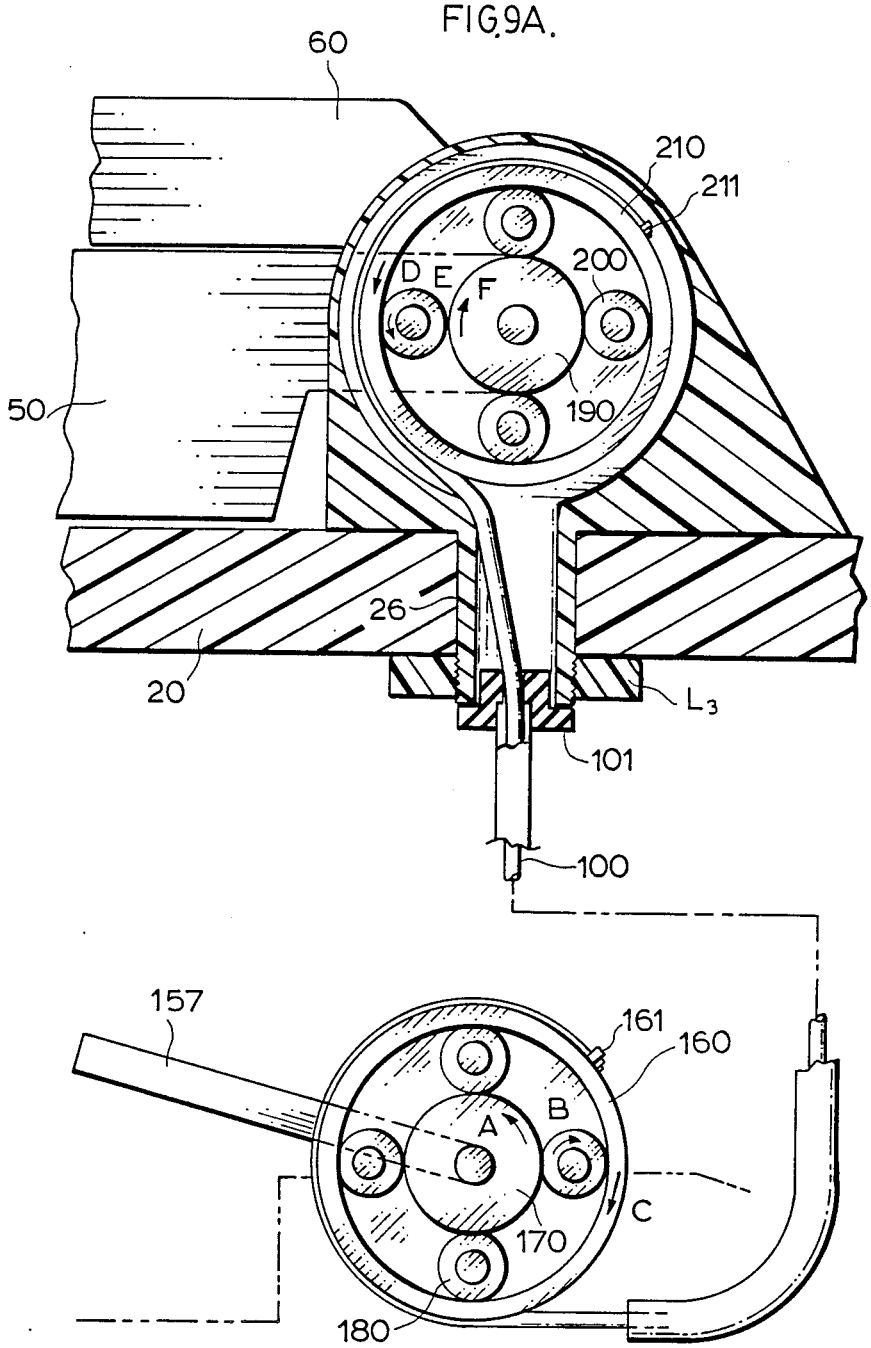
FIG. 9A is a side plan view to that of FIG. 9.

Referring now to FIGS. 9A, 9B and 9C such an assembly is illustrated best in FIG. 9A wherein a planetary gear system is found embodying the invention. Referring now to the lever illustrated in FIG. 9, there is found a portion 157 illustrated in FIG. 9A being connected to a sun gear 170 proximate the center thereof, the sun gear being in intermeshing contact with four planetary gears 180 disposed within the housing 159 being in intermeshing engagement with a ring gear 160 wherein the cable 100 is affixed to the exterior perimeter of the ring gear at 161. Thus when the lever 157 is rotated in a downward direction, the sun gear 170 will rotate in the direction A causing the planetary gears to rotate in the direction B which in turn will cause the ring gear to rotate in the direction C. Because of proportion it is recommended that the sun gear 170 be half of the diameter of the ring gear 160 (when considering the inner diameter). Thus the planetary gears will be defined as onequarter of the diameter of the ring gear 160. On the upper end of the assembly by hinge 90 there is found the planetary gear system comprising a sun gear 190, a planetary gear 200 and a ring gear 210 having the other end of the cable fastened thereto at 211 wherein movement of the cable and thus the ring gear in a direction D will result in movement of the planetary gear in a direction E and thus the rotation of the sun gear in a direction F. It is recommended that the ring gear 210 have the same diameter as the sun gear 170 of the lever 150 and that the sun gear 190 be half the diameter of the ring gear 210. Thus if a displacement of 30° is input into the lever 157, a displacement of 60° will be obtained at the toilet seat assembly and the rotating thereof. This will be described in more detail hereinafter. As illustrated in FIG. 9B and 9C it is of course not necessary that the sun gear assembly be a part of the crank or a part of the lever system. Any combinations of the cranks of FIGS. 6 and the lever of FIG. 9 or the hinge assembly of FIG. 9A with the lever assembly of FIGS. 3 through 5 would equally work as illustrated in FIG. 9B and 9C providing the displacement of the cable is determined to allow sufficient movement of the cranks and gear assemblies to providing a minimum of 60° rotation to the seat assembly 50 and 60. The sun gear 190 is attached to the shaft **120*a*** in FIG. 10 which causes the rotation thereof in the direction F as illustrated best in FIG. 9A.

Figure 6A:
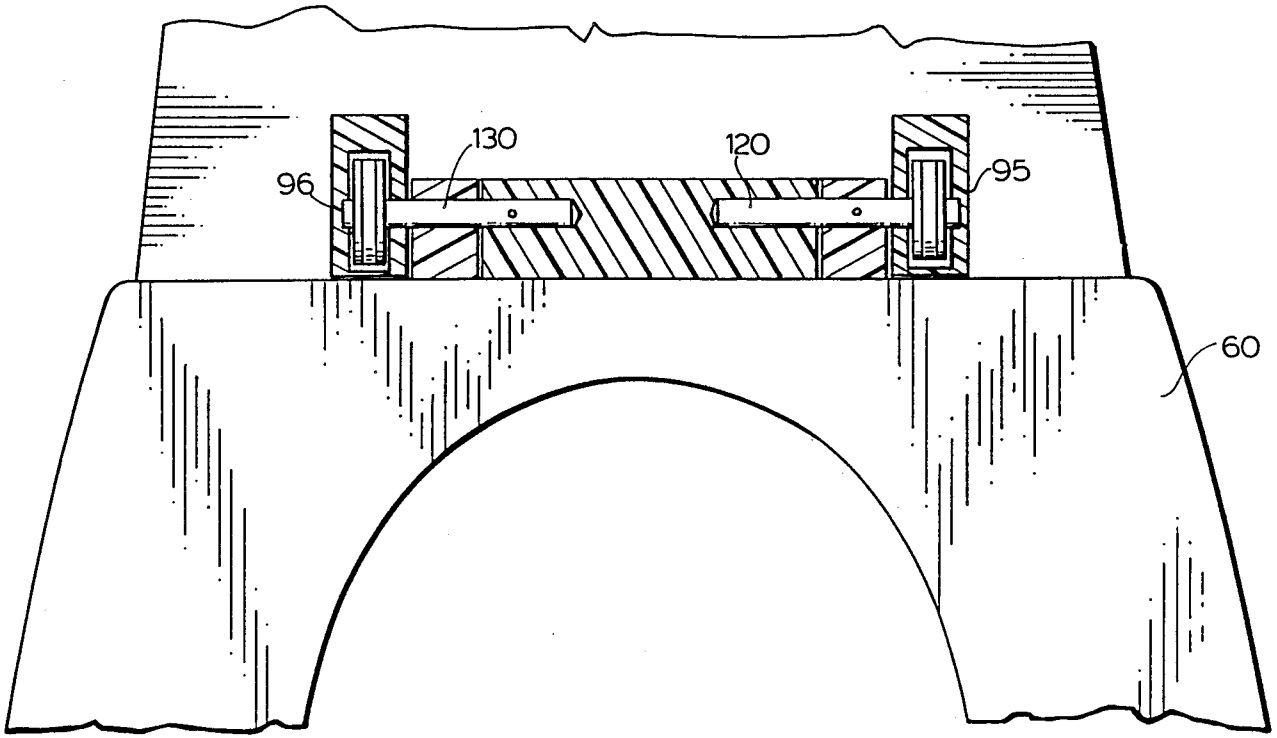
FIG. 6A is similar to the view in FIG. 6 wherein a preferred embodiment of the invention is illustrated.
Figure 10:
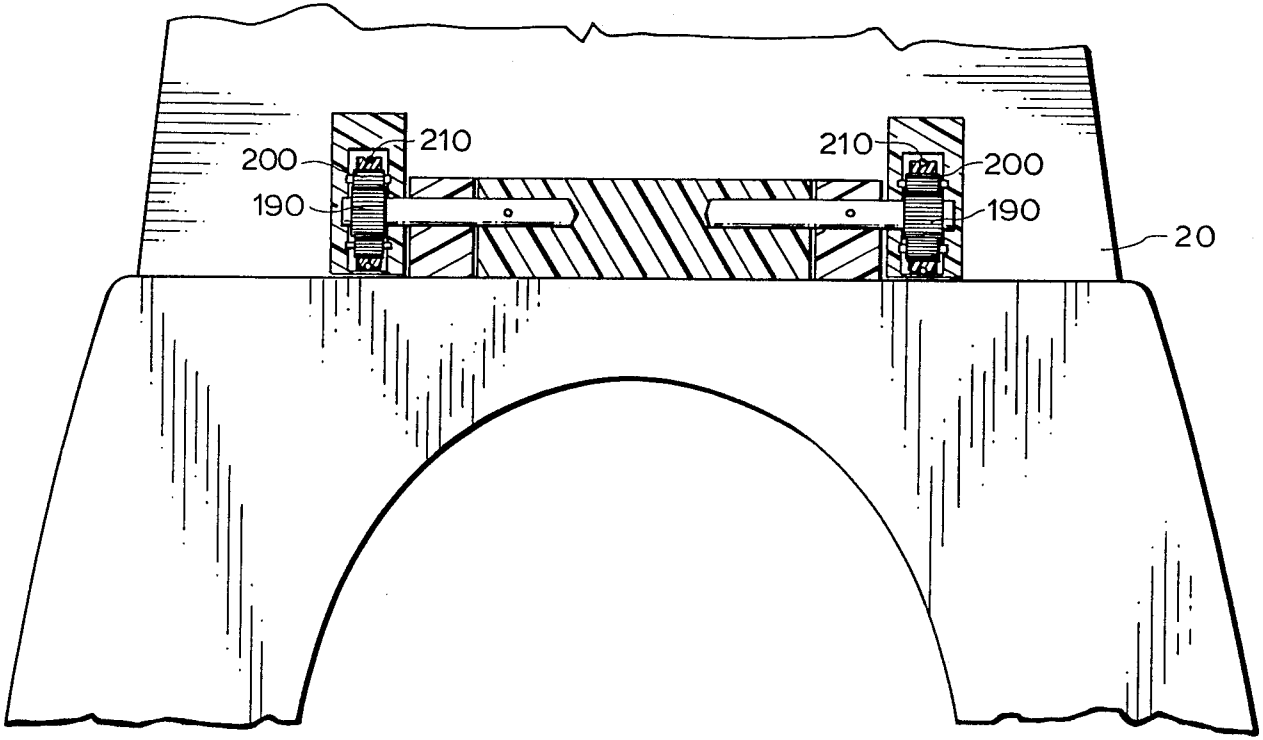
FIG. 10 is a similar view to that of FIG. 6A in another preferred embodiment of the invention.

Referring now to FIGS. 6A and 10, there is illustrated a top view of both assemblies incorporating the components thereof in the preferred embodiments of the invention illustrating the interrelationships of the components thereof and the workings of the components thereof when pivoting the seat assembly 50 and 60. Thus there is no real difference in the seat assembly other than the hinge members which are designed in order to allow for the pivoting of the seat assembling upon a common pivot as found in conventional toilet seats or any modified forms thereof, the details of which may be clearly observed in relation to the components thereof and the manufacture thereof in relation to FIGS. 6A and 10. Thus in FIG. 6A is observed the crank 96 and 95 interconnected by the seat itself 60 pivotably pins 120 and 130 having end caps to contain the components within the hinge assemblies 90, the end caps being threaded and having sufficient clearance to allow the rotation of the cranks 95 and 96. Referring to FIG. 10, again we incorporate within the housing caps a gear system attached to cranks **120*a* and 130*a*; which allow for movement of the toilet seat therewithin. (The gear system as best observed in relation to FIG. 11). It is of course not necessary to provide a planetary gear system at the end 96**. A conventional crank and dampening device may be used in preferred embodiments of the invention.

Figure 11:
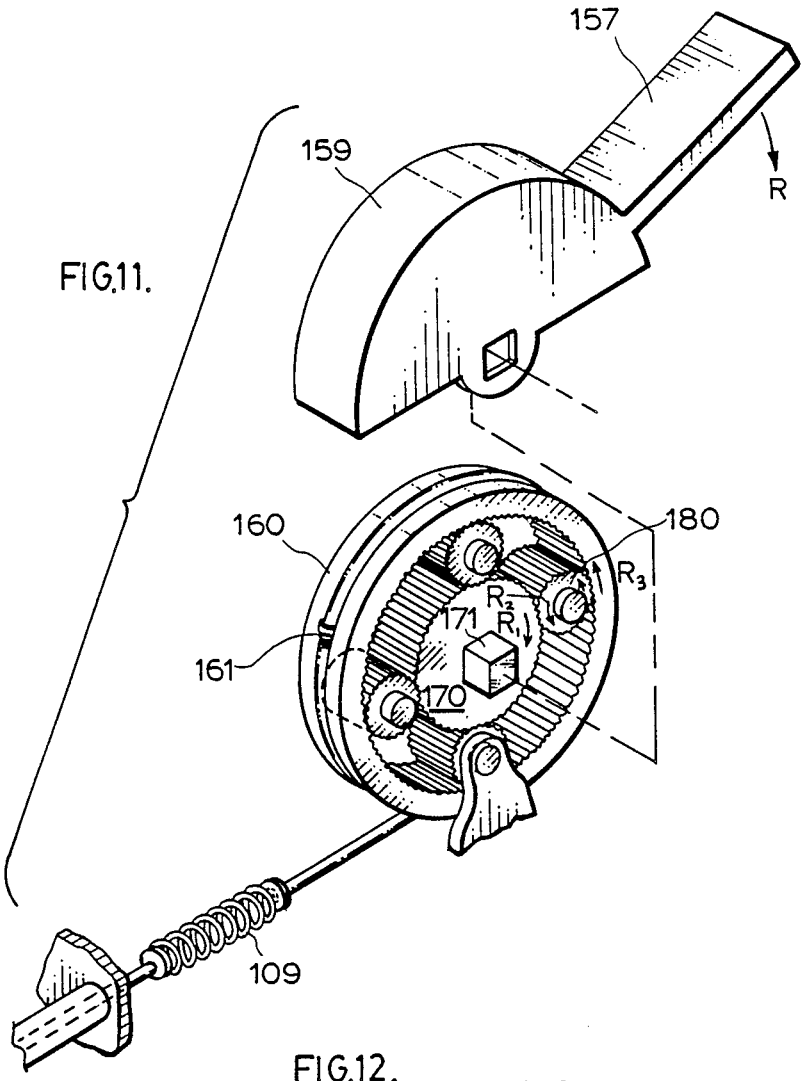
FIG. 11 is an exploded close-up perspective view of item 150 of FIG. 9.

Referring now to FIG. 11, there is illustrated in detail in exploded perspective the interrelationships between the sun gear 170 and the ring gears 160 intermeshed via the planetary gears 180. Hence when the sun gear which is pivoted via the lever 157 a distance R, the sun gear will rotate by detent 171 within the opening disposed upon the housing 159 a distance $R_1$ which will cause the planetary gear to rotate a distance $R_2$ counter to the direction of the rotation $R_1$ which is clockwise. The planetary gear will thus transmit the rotation to the ring gear $R_3$ which will rotate in the direction in $R_3$ of the predetermined distance. By having the cable 100 (not illustrated) affixed via a spring member 109 at one end thereof and to 161 at the other end thereof, there is a certain amount of dampening provided in the system.

Figure 12:
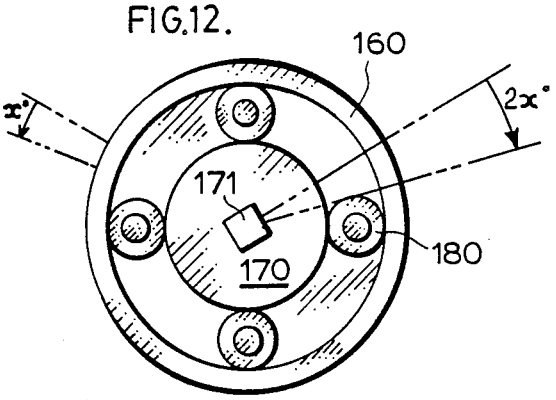
FIG. 12 is a schematic side plan view of the components illustrated in FIG. 11.

Referring now to FIG. 12, a close-up side plan schematic view of the planetary system of FIG. 11 is shown wherein a deflection $2x$ of the lever 157 will cause the sun gear to rotate an equivalent amount $2x°$ which is 30° in a preferred embodiment which will in turn cause the ring gear to rotate a distance of x° because of the diameters of the ring gear in relation to the diameter of the sun gear being two times. Thus the arc length covered by the sun gear is consistent with the arc length moved by the ring gear but the corresponding angle is diminished. However the torque passed on to the ring gear is doubled and any input force by an operator would be magnified at this point and passed on to the remaining portion of the mechanism, the details of which will be described in relation to FIG. 13.

Figure 13:
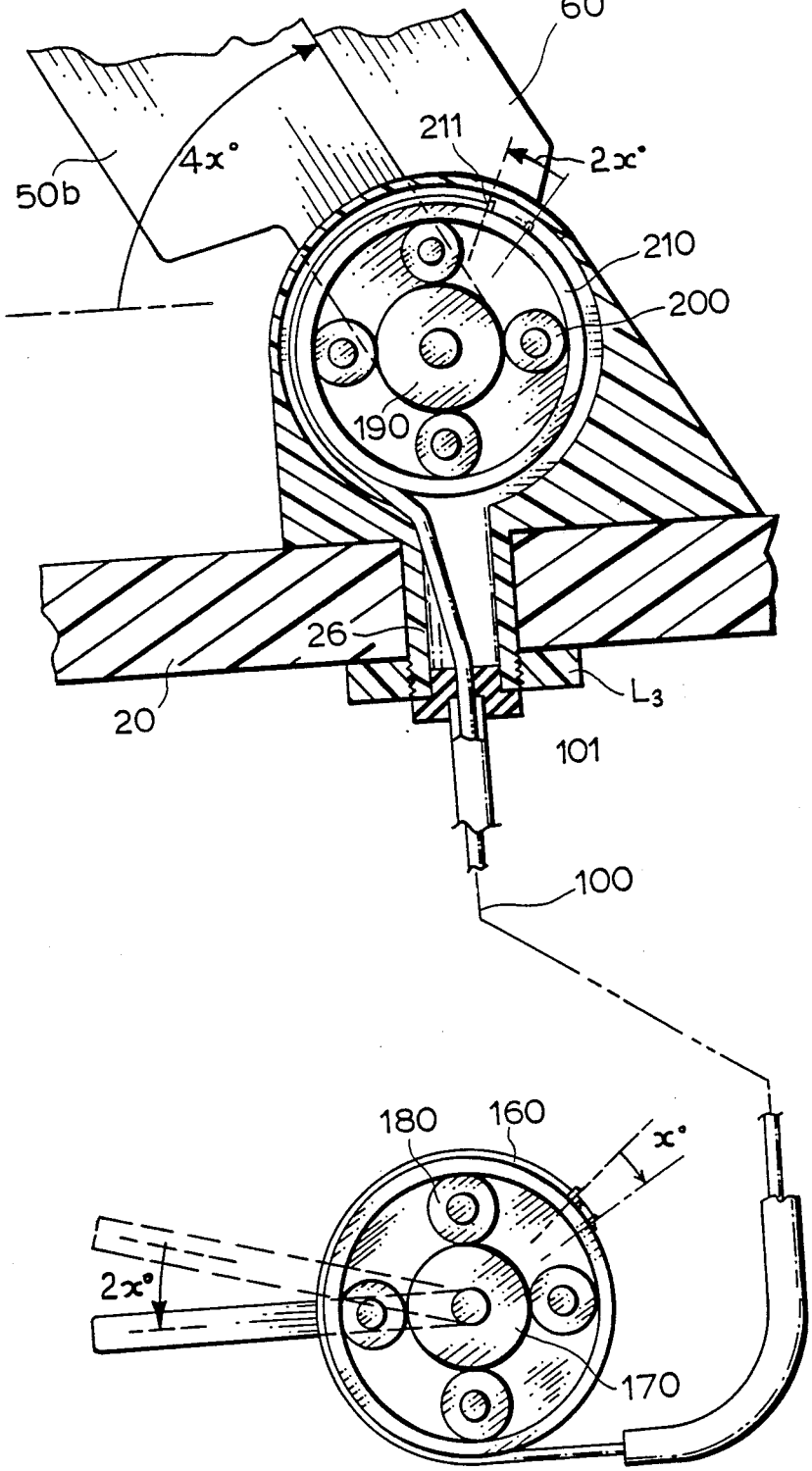
FIG. 13 is a schematic view of FIG. 9 illustrating the interrelationships of the components thereof.

Referring now to FIG. 13, a schematic interpretation of the mechanism of the instant invention is described wherein a planetary gear system is incorporated upon the bottom lever system of the invention and wherein the planetary gear system is incorporated upon the top hinge portion of the invention. It is important when considering the interrelationships of the invention that the sun gear 170 has the same diameter as the ring gear 210 of the hinge portion and wherein the ring gear 160 of the lever portion has twice the diameter of the ring gear 210 of the hinge portion and of the sun gear 170 of the lever portion. Further, the sun gear 190 has a diameter proportional to onehalf the diameter of the ring gear 210 of the hinge portion and of the sun gear 170 of the lever portion. The planetary gears 200 and 180 are typically one-quarter of the diameter of the ring gear circumscribing them. Thus in use the operator deflects the lever 157 in angle $2x$ with a force F from a position 1 to a position 2. The sun gear 170 of the lever mechanism 150 will thus rotate in the directions illustrated in FIG. 12 and being of a diameter $B_{170}$ will cause the ring gear 160 which is of a diameter $2B_{170}$ to rotate through a deflection amount of x° wherein 2x was the input of the system, x° will be the output. However, the force F will be magnified to a force 2F because of the ratio in the diameters of the ring gear versus the sun gear. The deflection x will be the amount of deflection which the cable 100 will move in a direction toward the lever system 150 and thus will cause the cable connected to the ring gear 210 at 211 to rotate in a counterclockwise direction the diameter of which is consistent with that of the sun gear in the lever assembly 150 and thus the ring gear will rotate a total deflection of 2x which is consistent with the arc distance throughout the system for displacing the cable. The force 2F will further be applied to the ring gear which will because of the ratio of the diameters of the ring gear of the hinge assembly to the sun gear of the hinge assembly reduce the force 2F to a force F which will be applied to the seat assembly 50 and 60 but whose deflection will now be 4x because of the increased distance the sun gear of the hinge assembly 190 will travel to correspond to the arc distance 2x of the ring gear in the hinge assembly. Thus, a deflection of 2x input to the system will cause a deflection of 4x to the seat assembly 50 and 60. In one example, in one of the preferred embodiments the input angle of deflection is 30° and the output angle of deflection is 60°.

In alternative embodiments of the invention, any permutation of combinations may be applied wherein the crank of FIGS. 6 may be used in relation to the lever system 150 wherein the deflection of the lever 157 will have to be considerably greater and predetermined but may be calculated by the methods described above.

In another alternative embodiment of the invention, a lever system of FIGS. 3 to 5 may be used in conjunction with the planetary gear system described in relation to FIG. 13 for the hinge assembly.

In another alternative embodiment of the invention, the dampening device will be incorporated with the planetary system disposed within the hinge assembly 90. It is also possible to have the lever of the gear assembly 150 attached to the ring gear and have the cable attached to the sun gear wherein an input of 2x will create a deflection of 4x to the sun gear and thus may be taken to the hinge assembly wherein a deflection input of 4x can be magnified to an input or output deflection of 8x from an input of 2x. For example if the input is 15° and the lever is attached to the ring gear of the lever assembly 150 then the output from the sun gear of the lever system will be 30°, which when translated to the ring gear and planetary gear system of the hinge assembly will be output as 60°.

Of course it is readily apparent from the above description that an operating device such as an electric, pneumatic or hydraulic drive may replace the cable actuated components without departing from the scope of the invention. Thus a planetary gear system embodied in the hinge may be driven by any of the afore-mentioned drives.

As many changes can be made to the invention without departing from the scope of the invention, it is intended that all material contained herein by interpreted as illustrative of the invention and not in a limiting sense.

The embodiments of the invention in which an exclusive property or privilege is claimed are as follows:

1. A mechanism for lifting and lowering a toilet seat assembly comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever causes rotation of the first rotatable shaft;

(c) operating means engaging the first crank means and the lever means whereby operating the lever means causes a displacement in the operating means sufficient to rotate the first crank means to pivot the toilet seat assembly to a raised position; and (d) releasable locking means for operably engaging the operating means proximate the lever means sufficient to prevent displacement of the operating means, whereby the toilet seat assembly may be locked in a raised non over centre position and whereby the releasable locking means when released permits the toilet seat assembly to be lowered, the toilet seat assembly being lowered by gravity when released and dampened in its motion by the dampening means connected to the second rotatable shaft wherein the hinge means comprises a planetary gear system having input means for receiving an applied force or displacement operably connected to the operating means and output means for pivoting the first rotatable shaft, and whereby the input is magnified by the planetary gear system to provide an increased output to the first rotatable shaft.

2. A mechanism for lifting and lowering a toilet seat comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever causes rotation of the first rotatable shaft;

(c) a section of Bowden cable attached at one end to the first crank means and attached at the opposite end to the lever means whereby the lever means when depressed causes linear displacement of the section of Bowden cable sufficient to cause the rotation of the first crank means to pivot the toilet seat assembly to a raised position;

(d) releasable locking means for operably engaging the section of Bowden cable sufficient to prevent linear displacement of the Bowden cable whereby the toilet seat assembly may be locked in a raised non over centre position and whereby the releasable locking means when released permits the toilet seat assembly to be lowered, the seat assembly being lowered by gravity when released and dampened in its motion by the dampening means connected to the second rotatable shaft wherein the hinge means comprises a planetary gear system having input means for receiving an applied force or displacement operably connected to the Bowden cable and output means for pivoting the first rotatable shaft, and whereby the input is magnified by the planetary gear system to provide an increased output to the first rotatable shaft.

3. A mechanism for lifting and lowering a toilet seat assembly comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever means causes rotation of the first rotatable shaft;

(c) operating means engaging the first crank means whereby operating the lever means causes a displacement in the operating means sufficient to rotate the first crank means to pivot the toilet seat assembly to a raised position; and (d) releasable locking means for operably engaging the operating means proximate the lever means sufficient to prevent displacement of the operating means, whereby the toilet seat assembly may be locked in a raised non over centre position and whereby the releasable locking means when released permits the toilet seat assembly to be lowered, the toilet seat assembly being lowered by gravity when released and dampened in its motion by the dampening means connected to the second rotatable shaft wherein the lever means comprises a planetary gear system having input means for applying a force or displacement and output means operably connected to the operating means, wherein the planetary gear system magnifies the input to produce a greater output to the operating means.

4. A mechanism for lifting and lowering a toilet seat assembly comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever means causes rotation of the first rotatable shaft;

(c) a section of Bowden cable attached at one end to the first crank means and attached at the opposite end to the lever means whereby the lever means when depressed causes linear displacement of the section of Bowden cable sufficient to cause the rotation of the first crank means to pivot the toilet seat assembly to a raised position; and (d) releasable locking means for operably engaging the section of Bowden cable sufficient to prevent displacement of the Bowden cable whereby the toilet seat assembly may be locked in a raised non over centre position and whereby the releasable locking means when released permits the toilet seat assembly to be lowered, the toilet seat assembly being lowered by gravity when released and dampened in its motion by the dampening means connected to the second rotatable shaft wherein the lever means comprises a planetary gear system having input means for applying a force or displacement and output means operably connected to the Bowden cable, wherein the planetary gear system magnifies the input to produce a greater output to the operating means.

5. A mechanism for lifting and lowering a toilet seat assembly comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever means causes rotation of the first rotatable shaft;

(c) operating means engaging the first crank means whereby operating the lever means causes a displacement in the operating means sufficient to rotate the first crank means to pivot the toilet seat assembly to a raised position; and (d) releasable locking means for operably engaging the operating means proximate the lever means sufficient to prevent displacement of the operating means, whereby the toilet seat assembly may be locked in a raised non over centre position and whereby the releasable locking means when released permits the toilet seat assembly to be lowered, the toilet seat assembly being lowered by gravity when released and dampened in its motion by the dampening means connected to the second rotatable shaft wherein:

(a) the hinge means comprises a planetary gear system having input means for receiving an applied force or displacement operably connected to the operating means and output means for pivoting the first rotatable shaft, and whereby the input is magnified by the planetary gear system to provide an increased output to the first rotatable shaft;

(b) the lever means comprises a planetary gear system having input means for applying a force or displacement and output means operably connected to the operating means, wherein the planetary gear system magnifies the input to produce a greater output to the operating means.

6. A mechanism for lifting and lowering a toilet seat assembly comprising:

(a) a toilet seat assembly pivotally attached at its rear edge to a toilet base by first and second hinge means having first and second rotatable shafts attached to the seat assembly, the seat assembly having first and second crank means the first crank means connected to the first rotatable shaft suitable for rotating the shaft to pivot the seat assembly, the second rotatable shaft and second crank means being also connected to dampening means to dampen the movement of the seat assembly when released from a stationary position;

(b) lever means operably engaging the first crank means whereby depressing the lever means causes rotation of the first rotatable shaft;

(c) a section of Bowden cable attached at one end to the first crank means and attached at the opposite end to the lever means whereby the lever means when depressed causes linear displacement of the section of Bowden cable sufficient to cause the rotation of the first crank means to pivot the toilet seat assembly to a raised position; and (d) releasable locking means for operably engaging the section of Bowden cable sufficient to prevent displacement of the Bowden cable whereby the toilet seat assembly may be locked in a raised non over centre position and whereby the releasable locking means when released permits the toilet seat assembly to be lowered, the toilet seat assembly being lowered by gravity when released and dampened in its motion by the dampening means connected to the second rotatable shaft wherein:

(a) the hinge means comprises a planetary gear system having input means for receiving an applied force or displacement operably connected to the Bowden cable and output means for pivoting the first rotatable shaft, and whereby the input is magnified by the planetary gear system to provide an increased output to the first rotatable shaft;

(b) the lever means comprises a planetary gear system having input means for applying a force or displacement and output means operably connected to the Bowden cable, wherein the planetary gear system magnifies the input to produce a greater output to the operating means.

7. For use in lifting or lowering a toilet seat assembly pivotable upon its rear hinge having a central pivot, at least one lever means adapted to be operatively connected with the central pivot, the at least one lever means comprising:

(a) input operating means for activating said lever means;

(b) gearing means engaged to said input operating means comprising a planetary gear system having a sun gear surrounded by at least one planetary gear in contact therewith and a ring gear contacting at least one planetary gear;

(c) output operating means fastened to one of said gears and adapted to be operatively connected with the hinge of the seat assembly in use;

(d) housing means containing said gearing means;

whereby any input displacement, torque, or force applied to said at least one lever means by said input operating means is modified by said lever means, said modified displacement, torque or force being transferred to said output operating means by said gearing means, whereby the hinge of the seat assembly causes movement of the seat assembly when the lever means is used.

8. The lifting mechanism of claim 7 wherein the gearing means further comprising a sun gear being substantially half the diameter of the ring gear wherein the input operating means is connected to said sun gear and said output operating means is a cable attached upon the perimeter of the ring gear at one end thereof and attached to means to pivot the central pivot of said rear hinge of said toilet seat assembly.

9. The lifting mechanism of claim 7 wherein the gearing means further comprising a sun gear being substantially half the diameter of the ring gear wherein the input operating means is connected to said ring gear and said output operating means is connected to said sun gear attached to pivot the central pivot of said rear hinge of said toilet seat assembly.

10. The mechanism for raising a toilet seat assembly of claim 7, 8, or 9 further comprising releasable locking means to lock the seat assembly in place when raised.

11. The mechanism of claim 17 further comprising dampening means to control the lowering of the toilet seat assembly when the locking means is released.

12. The lifting mechanism of claim 7 wherein the at least one lever means comprises a first and second lever means interconnected by cable means, the first lever means comprising a foot-operated pedal having one end of the cable means connected to a first ring gear and having the input operating means connected to a first sun gear, the first sun gear being substantially one-half in diameter of the first ring gear; the second lever means comprising a second ring gear connected to the other end of the cable means and having output operating means connected to a second sun gear, the second sun gear being substantially one-half the diameter of the second ring gear and one-quarter the diameter of the first ring gear.

13. The mechanism for raising a toilet seat assembly of claim 12 further comprising releasable locking means to lock the seat assembly in place when raised.

14. The mechanism of claim 13 further comprising dampening means to control the lowering of the toilet seat assembly when the locking means is released.

* * * * *